United States Patent [19]

Vergiels

[11] 4,381,071

[45] Apr. 26, 1983

[54] FOLDABLE BLANK BOX

[75] Inventor: Vern O. Vergiels, Temperance, Mich.

[73] Assignee: Tecumseh Corrugated Box Company, Tecumseh, Mich.

[21] Appl. No.: 279,733

[22] Filed: Jul. 2, 1981

[51] Int. Cl.[3] ..... B65D 5/66; B65D 5/18

[52] U.S. Cl. ..... 229/16 R; 229/44 R

[58] Field of Search ..... 229/16 R, 16 A, 41 R, 229/44 R

[56] References Cited

U.S. PATENT DOCUMENTS

| | | | |
|---|---|---|---|
| 1,109,468 | 9/1914 | Rose . | |
| 1,165,908 | 12/1915 | Pietveld | 229/44 R |
| 1,251,921 | 1/1918 | Rich | 229/44 R |
| 2,247,870 | 7/1941 | Chalmers | 229/44 R |
| 2,349,238 | 5/1944 | Burre | 229/44 R |
| 2,393,734 | 1/1946 | Beardsell . | |
| 2,514,381 | 7/1950 | Feigelman . | |
| 2,771,986 | 11/1956 | Bekoff | 229/44 R |
| 3,799,332 | 3/1974 | Jeronimus | 229/44 R |

FOREIGN PATENT DOCUMENTS

| | | | |
|---|---|---|---|
| 172757 | 10/1952 | Austria | 229/16 R |
| 732014 | 6/1955 | United Kingdom | 229/16 R |
| 1097804 | 1/1968 | United Kingdom | 229/44 R |

*Primary Examiner*—Herbert F. Ross

*Attorney, Agent, or Firm*—Wilson, Fraser, Barker & Clemens

[57] ABSTRACT

An erectable container folded from a sheet material configured in a T-shape having a shank section and a head section including oppositely extending wings. The wings are folded back onto the head section which in turn is folded onto the shank section to create a hollow body having a closed end and an open end. The shank section includes a tab struck from one wall adjacent the free end thereof which engages a marginal panel of the hollow body and holds the container in an erected, open position for inserting an article therein.

9 Claims, 5 Drawing Figures

FOLDABLE BLANK BOX

BACKGROUND OF THE INVENTION

1. Field of the Invention

This invention relates to boxes or containers and more particularly to a box formed of a foldable corrugated board stock provided with a locking tab for holding the box in an erected, open position during the packing or filling thereof.

2. Description Of The Prior Art.

Erectable foldable boxes formed from unitary blanks of sheet material and adaptable for a variety of purposes are well known in the prior art. Conventionally, small articles such as timing gears, bearings, journal crosses and the like are manually packaged in small boxes for sale in the aftermarket. Such articles are usually packed with grease and/or coated with rust preventative oil for their preservation and an operator manually handles such articles in packaging them. Accordingly, the boxes may become soiled when the articles are manually inserted into the boxes thus destroying the boxes' aesthetic appearance for sale in the aftermarket. It is to overcome this problem that the invention is directed.

SUMMARY OF THE INVENTION

Briefly, the container of the present invention is formed from a unitary, corrugated paperboard blank scored and folded to produce a container which may be maintained in an erected, open position for readily receiving articles therein. Generally, the container is formed from a blank having a T-shape configuration including a shank section and a head section with oppositely extending wings. The wings are first folded and bent back onto the head section which is then folded onto the shank section. The shank section is provided with a tab struck from a closure panel of the blank for holding the container in the erected, open position. The shank section is also provided with a locking tab and after an article is inserted into the container the locking tab is folded and tucked into the container by tucking it into a die cut slot formed in the closure panel.

An object of the invention is to produce a container from a unitary corrugated paperboard blank which is held in an erected open position for packing after which the container is closed and locked in the closed position.

BRIEF DESCRIPTION OF THE DRAWINGS

The above mentioned and other features, objects and advantages and a manner of obtaining them are described more specifically below by reference to an embodiment of the invention shown in the accompanying drawings; in which.

DESCRIPTION OF THE PREFERRED EMBODIMENTS

Figure 1:
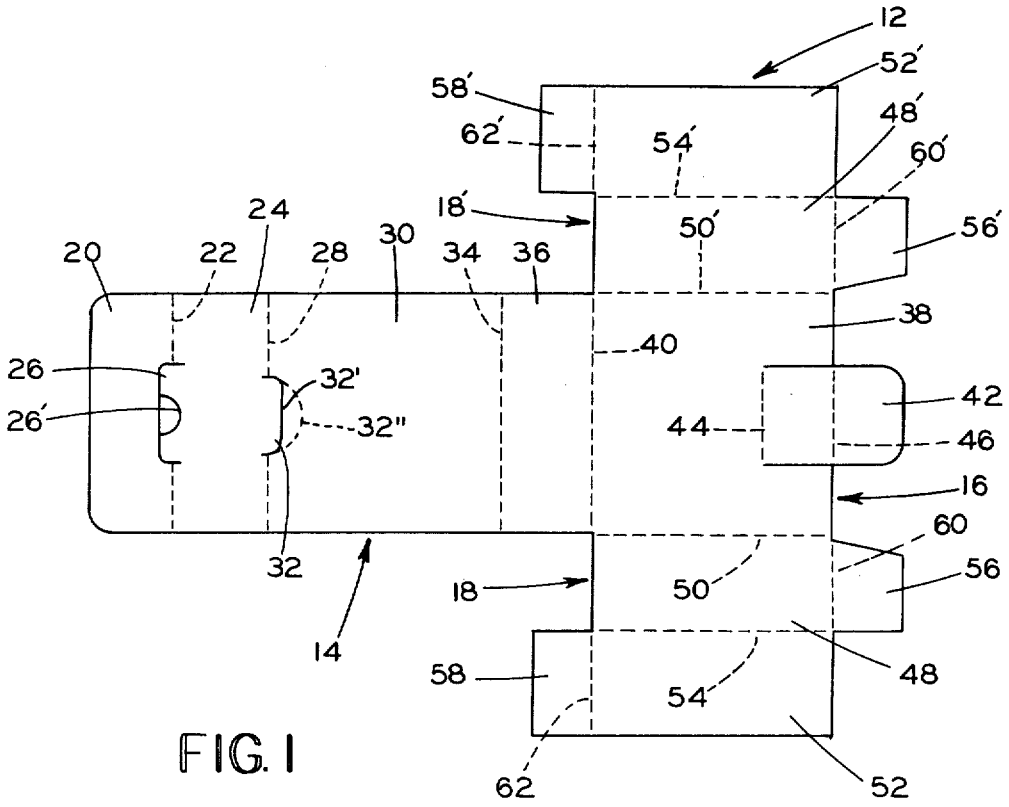
FIG. 1 is a plan view of the blank from which the container is folded.

Referring now to the drawings, a container or box 10 is illustrated as resting upon a certain side for ease of description and will be referred to hereinafter as the bottom of the box. However, it will be understood that this term as well as the other terms employed in the following description are purely relative and only describe the box in this position.

As illustrated in FIG. 1, the blank 12 from which the box 10 is formed, is a unitary sheet member of T-shape configuration generally including a shank section 14 and a head section 16 having oppositely extending wing panels 18 and 18'. However, it should be understood that other shape unitary blanks may be employed. For example, a blank having an L-shape configuration may be employed wherein the leg of the L incorporates all of the elements of the two wings in one manner or another.

The shank section 14 is divided into a flap panel 20 hingedly connected by an intermittent, transversely extending score or fold line 22 to a closure panel 24, the latter having a flange 26 including a cut-out portion 26' extending into the flap panel 20, the purpose of which will be described hereinafter. The closure panel 24 is hingedly connected by an intermittent, transversely extending score or fold line 28 to a primary bottom panel 30, the former having a tab 32 struck therefrom and extending into the bottom panel 30, the purpose of which also will be described hereinafter. The bottom panel 30 is hingedly connected by a score or fold line 34 to an end panel 36.

The head section 16 generally comprises a top panel 38 hingedly connected by a score or fold line 40 to the end panel 36. The top panel 38 is provided with an elongate tongue 42 struck therefrom and extending from an inner portion of the panel 38 beyond the outer marginal edge of the panel. The tongue 42 is hingedly connected to the top panel 38 by a score or fold line 44. The tongue 42 also is provided with a score or fold line 46.

The wing sections 18 and 18' include a side panel 48 and 48', respectively, hingedly connected to the top panel 38 by a score or fold line 50 and 50', respectively. An auxillary bottom panel portion 52 and 52' is respectively hingedly connected by a score or fold line 54 and 54' to the side panel 48 and 48'. Flaps 56–56' and 58–58' are respectively connected at fold lines 60–60' and 62–62' to the side panel 48 and 48' and the auxillary bottom panel 52 and 52'.

Figure 2:
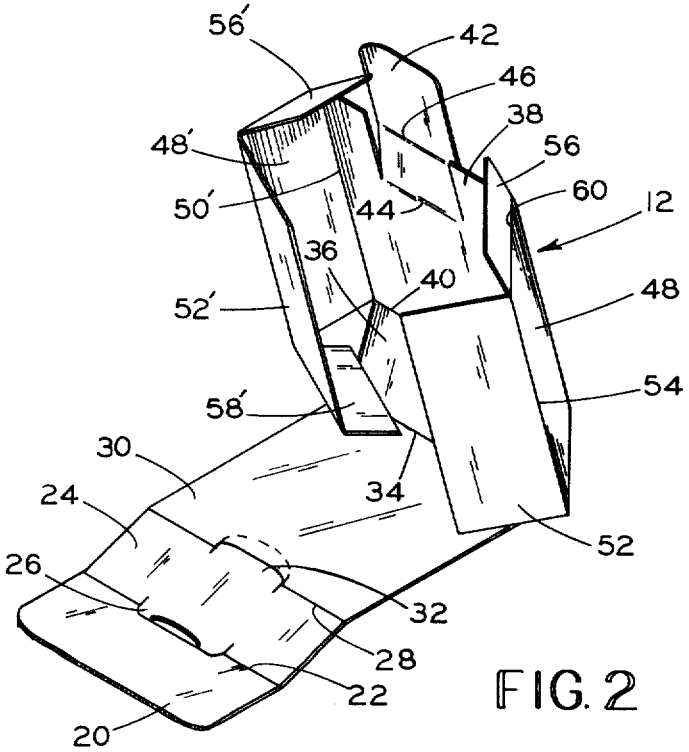
FIG. 2 is a perspective view of the partially folded container formed from the blank illustrated in FIG. 1.

Referring now to FIG. 2, the auxillary bottom panels 52 and 52' are folded along their respective fold lines 54 and 54'. The side panels 48 and 48' are folded along their respective fold lines 50 and 50' and the flaps 58 and 58' are folded along their respective fold lines 62 and 62' to cause the opposed outer edges of the auxillary bottom panels 52 and 52' to be moved into abutting relation with one another. The top panel 38 is then folded along its fold line 40 about the end panel 36.

At this point in the erection of the container, the bottom panel 30, the closure panel 24, and the flap panel 20 are concommitantly moved above the fold line 34 into a position wherein the inner surface of the bottom panel 30 is juxtaposed with the outer surfaces of the auxillary bottom panels 52 and 52'. Accordingly, a hollow body portion having a closed end and an open end is formed. Next, the flap panel 20 and the closure panel 24 are rocked outwardly to cause a release of the locking tab 32 from the adjacent material of the bottom panel 30. The locking tab 32 is caused to be positioned over the upper or outwardly abutting marginal corners of the auxillary bottom panels 52 and 52' and thence the flap panel 20 and the closure panel 24 are released thereby permitting the locking tab 32 to be urged into a locking mode securely retaining the panels 52 and 52' in the erected position.

Figure 3:
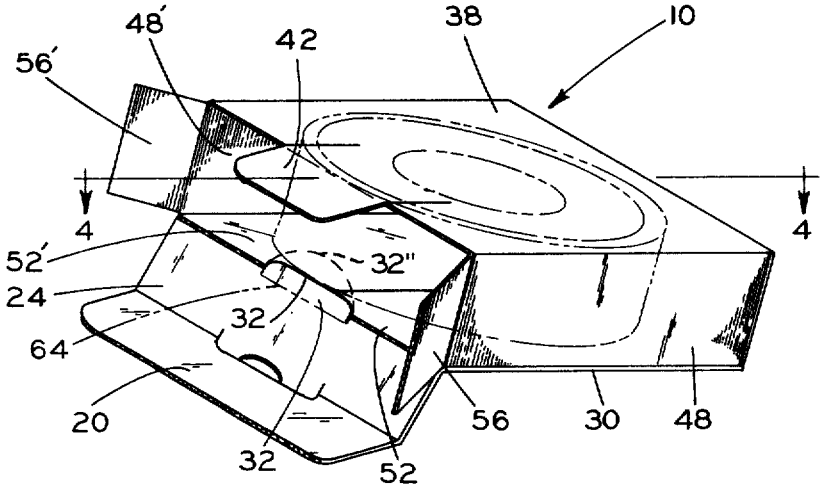
FIG. 3 is a perspective view of the folded container held in an erected, open condition for inserting an article therein.
Figure 4:
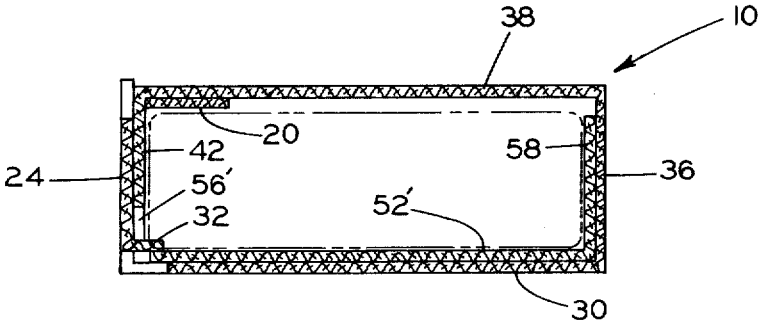
FIG. 4 is a cross-sectional view of a closed, locked container taken substantially along line 4—4 of FIG. 3.

The closure panel 24 and flap 20 may then be further flexed, if necessary, to support the erected open box 10 in the inclined position of FIG. 3, thus permitting an article to be inserted into the erected container without grasping the outer surface of the container walls. After the article is placed in the container, an operator having the necessary clean hands first folds the flaps 56 and 56' inwardly along the fold lines 60 and 60', respectively, and folds the closure panel 24 along its fold line 28, and the flap 20 along its fold line, and tucks the flap 20 beneath the top panel 38 as illustrated in FIG. 4. The locking tongue 42 is then folded at its fold line 42 and 46 and tucked behind the slotted flange 26 of the closure panel 24.

Referring now to FIG. 3, it will be noted that the locking tab 32 is not provided with a fold line so that the tab 32 will firmly hold the box 10 in an erected open position. However, when the closure panel 24 is moved about the fold line 28 so its inner surface is juxtaposed with the outer surfaces of the flaps 56 and 56', a crease 64 is formed across the base of the tab 32. Thus, when the flap 20 is tucked behind the flap 26 as previously described, the tab 32 flatly engages the upper surfaces of the auxillary bottom panels as illustrated in FIG. 4.

The tab 32, illustrated in the drawing figures may be provided with either a rectangular or radius configuration 32' and 32'', respectively, for engaging a substantial portion of the abutting marginal corners of the auxillary bottom panels 52 and 52'.

Figure 5:
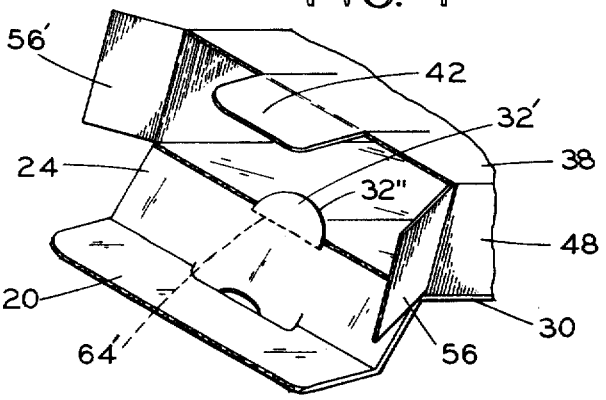
FIG. 5 is a fragmentary perspective view of another embodiment of the tab holding the container in an erected, open position.

In another embodiment of the invention, as illustrated in FIG. 5, the tab 32'' may be of an arcuate configuration for only engaging minor portions of the abutting marginal corners of the auxillary bottom panels 52 and 52'. This tab configuration tends to concentrate the forces acting to bend the tab 32 within a relatively small area, thereby resulting in a more even fold line at the juncture of the tab 32 and the closure panel 24.

Although the container has been described as being made from a sheet of corrugated paperboard material, it will be noted that any type of sheet material such as kraft paper, plastic, or like materials may be employed.

It is to be understood that the form of the invention herewith shown and described is to be taken as a preferred embodiment only of the same and that various changes in the shape, size, and arrangement of the parts may be resorted to without departing from the spirit of the invention.

What is claimed is:

1. A container formed of sheet material comprising:
   a. top, bottom, side and end panel means hingedly connected together defining a hollow body portion closed at one end and open at the opposite end;
   b. auxillary panel means lying adjacent a portion of the inner surface said bottom panel and having marginal edges aligned adjacent the open end of the said hollow body portion;
   c. closure means extending from the end of bottom panel means for closing the open end of said hollow body portion; and
   d. locking means struck from said closure means and said bottom panel means for engaging said aligned marginal edges of said hollow body portion when said closure means is bent away from said body portion whereby said body portion is held in an erected, open position by said locking means and supported in an inclined position by said closure means for permitting an article to be inserted into said container without grasping the outer surfaces of the sides thereof.

2. The invention according to claim 1 wherein said locking means comprises a rectangularly shape tab.

3. The invention according to claim 1 wherein said locking means comprises a radially shape tab.

4. The invention according to claim 1 wherein said locking means comprises an arcuately shape tab.

5. An erectable box folded from a unitary blank, comprising:
   a. a sheet member configured to form a shank section and a head section;
   b. said shank section being transversely scored in a direction perpendicular to the long axis of the shank to form a bottom panel, a closure panel and an end panel;
   c. said head section being transversely scored in a direction coincident to the long axis of the shank to form a top panel, two side panels and an auxillary panel means; and
   d. locking means struck from said closure panel and extending into said bottom panel so that when the box is erected the locking means projects upwardly and inwardly over the marginal upper edge of said auxiliary panel means for holding the folded box in an erected open position whereby the erected open box is supported by said closure means in an inclined position so that an article may be inserted therein without grasping the box.

6. The invention according to claim 5 wherein said locking means comprises a rectangularly shape tab.

7. The invention according to claim 5 wherein said locking means comprises a radial shape tab.

8. The invention according to claim 5 wherein said locking means includes an arcuately shape tab.

9. An erectable box folded form a unitary blank, comprising:
   a. a primary bottom panel;
   b. a closure panel hinged along one edge thereof to one edge of said primary bottom panel;
   c. an end panel hinged along one edge thereof to the edge of said primary bottom panel opposite the hinged edge of said closure panel;
   d. a top panel hinged along one edge thereof to the edge of said end panel opposite the hinged edge of said bottom panel;
   e. a side panel hinged along one edge thereof to each of two opposite edges of said top panel;
   f. an auxiliary bottom flap hinged along one edge thereof to each of said side panels; and
   g. a locking tab cut in the hinged edge of said closure panel and extending into said bottom panel whereby it projects upwardly and inwardly over the marginal upper edge of said auxiliary bottom flaps for holding the folded box in an erected, open position and said closure panel supports the erected, open box in an inclined position so that an article may be inserted therein without grasping the box.

* * * * *